US009259930B2

(12) United States Patent
Kimura et al.

(10) Patent No.: US 9,259,930 B2
(45) Date of Patent: Feb. 16, 2016

(54) LIQUID EJECTION HEAD AND IMAGE FORMING APPARATUS INCLUDING SAME

(71) Applicants: Yuu Kimura, Kanagawa (JP); Takahiro Yoshida, Kanagawa (JP)

(72) Inventors: Yuu Kimura, Kanagawa (JP); Takahiro Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/174,304

(22) Filed: Feb. 6, 2014

(65) Prior Publication Data

US 2014/0232796 A1 Aug. 21, 2014

(30) Foreign Application Priority Data

Feb. 18, 2013 (JP) ..... 2013-029506

(51) Int. Cl.

| | |
|---|---|
| ***B41J 2/17*** | (2006.01) |
| ***B41J 2/175*** | (2006.01) |
| ***B41J 2/14*** | (2006.01) |
| ***B41J 2/16*** | (2006.01) |
| ***B41J 2/055*** | (2006.01) |

(52) U.S. Cl.

CPC ..... *B41J 2/14274* (2013.01); *B41J 2/055* (2013.01); *B41J 2/1612* (2013.01); *B41J 2/1623* (2013.01); *B41J 2/1626* (2013.01); *B41J 2/1632* (2013.01); *B41J 2/175* (2013.01); *B41J 2/17513* (2013.01); *B41J 2002/14419* (2013.01)

(58) Field of Classification Search

CPC .. B41J 2/175; B41J 2/055; B41J 2002/14419; B41J 2/17513; B41J 2/17503; B41J 2/17553; B41J 2/19; B41J 2/17563; B41J 2002/14403; B41J 2/14274; B41J 2/1612; B41J 2/1623; B41J 2/1626; B41J 2/1632

See application file for complete search history.

(56) References Cited

U.S. PATENT DOCUMENTS

| | | | | |
|---|---|---|---|---|
| 7,712,885 | B2 * | 5/2010 | Kojima | 347/94 |
| 2003/0001936 | A1 * | 1/2003 | Hirosawa et al. | 347/87 |
| 2004/0252151 | A1 * | 12/2004 | Higuchi et al. | 347/19 |
| 2006/0007272 | A1 | 1/2006 | Ogata et al. | |
| 2006/0012645 | A1 * | 1/2006 | Nagashima | 347/68 |
| 2006/0012647 | A1 * | 1/2006 | Yamada et al. | 347/71 |
| 2006/0050111 | A1 * | 3/2006 | Mataki | 347/68 |

(Continued)

FOREIGN PATENT DOCUMENTS

| | | |
|---|---|---|
| JP | 2000-043253 | 2/2000 |
| JP | 2004284196 A * | 10/2004 |

(Continued)

OTHER PUBLICATIONS

U.S. Appl. No. 14/020,038, filed Sep. 6, 2013.

*Primary Examiner* — Julian Huffman
*Assistant Examiner* — Leonard S Liang
(74) *Attorney, Agent, or Firm* — Cooper & Dunham LLP

(57) ABSTRACT

A liquid ejection head includes a nozzle plate, a channel plate, a common-liquid-chamber member, and a deformable damper area. The nozzle plate includes plural nozzles to eject droplets of liquid. The channel plate includes individual liquid chambers communicated with the nozzles. The common-liquid-chamber member includes a common liquid chamber to supply the liquid to the individual liquid chambers. The deformable damper area forms a wall face of the common liquid chamber. The channel plate has an end in a direction perpendicular to a nozzle array direction in which the nozzles are arrayed. The end is opposed to a portion of the damper area and has a relief at a side facing the damper area to permit deformation of the damper area.

7 Claims, 23 Drawing Sheets

(56) References Cited

U.S. PATENT DOCUMENTS

| | | | | |
|---|---|---|---|---|
| 2006/0055743 | A1* | 3/2006 | Kodama et al. | 347/68 |
| 2006/0061624 | A1* | 3/2006 | Nagashima | 347/54 |
| 2006/0061632 | A1* | 3/2006 | Mita | 347/68 |
| 2006/0061634 | A1* | 3/2006 | Hori | 347/71 |
| 2006/0066676 | A1* | 3/2006 | Sanada | 347/50 |
| 2006/0066677 | A1* | 3/2006 | Hori | 347/50 |
| 2006/0066685 | A1* | 3/2006 | Sugahara | 347/68 |
| 2006/0066686 | A1* | 3/2006 | Mita | 347/68 |
| 2006/0176332 | A1* | 8/2006 | Chikamoto | 347/20 |
| 2006/0203044 | A1* | 9/2006 | Enomoto et al. | 347/71 |
| 2006/0221143 | A1* | 10/2006 | Kodama | 347/70 |
| 2006/0221144 | A1* | 10/2006 | Nagashima | 347/70 |
| 2006/0232640 | A1* | 10/2006 | Ota | 347/68 |
| 2006/0250455 | A1* | 11/2006 | Kojima | 347/68 |
| 2007/0103519 | A1* | 5/2007 | Takahashi et al. | 347/85 |
| 2007/0206058 | A1* | 9/2007 | Takahashi | 347/54 |
| 2008/0111862 | A1* | 5/2008 | Sasaki | 347/54 |
| 2008/0117262 | A1 | 5/2008 | Mori et al. | |
| 2009/0102907 | A1 | 4/2009 | Yamanaka et al. | |
| 2011/0057992 | A1* | 3/2011 | Tobita et al. | 347/54 |
| 2011/0096113 | A1 | 4/2011 | Yoshida | |
| 2011/0122207 | A1* | 5/2011 | Shin et al. | 347/85 |
| 2012/0236080 | A1 | 9/2012 | Yoshida et al. | |
| 2013/0147887 | A1 | 6/2013 | Kimura et al. | |

FOREIGN PATENT DOCUMENTS

| | | |
|---|---|---|
| JP | 2007-331167 | 12/2007 |
| JP | 2009-040064 | 2/2009 |
| JP | 2009-178966 | 8/2009 |
| JP | 2010-214847 | 9/2010 |
| JP | 2011-056924 | 3/2011 |

* cited by examiner

LIQUID EJECTION HEAD AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2013-029506, filed on Feb. 18, 2013, in the Japan Patent Office, the entire disclosure of which is hereby incorporated by reference herein.

BACKGROUND

1. Technical Field

Embodiments of this disclosure relate to a liquid ejection head and an image forming apparatus including the liquid ejection head.

2. Description of the Related Art

Image forming apparatuses are used as printers, facsimile machines, copiers, plotters, or multi-functional devices having two or more of the foregoing capabilities. As one type of image funning apparatuses employing a liquid-ejection recording method, for example, inkjet recording apparatuses are known that use a recording head (liquid ejection head or liquid-droplet ejection head) for ejecting droplets of liquid (e.g., ink).

In a liquid ejection head, when an individual channel is pressurized to eject a droplet, pressure fluctuation occurring in the individual channel is changed into a pressure wave and the pressure wave is also propagated to a common liquid chamber (a common channel) for supplying liquid to plural individual channels. When the pressure wave propagated to the common liquid chamber is inversely propagated to the individual channel, the pressure of the individual channel is caused to fluctuate so that a meniscus of a nozzle cannot be controlled. Consequently, a droplet cannot be ejected at a desired droplet speed and a droplet amount (droplet volume) or no droplet is ejected. When the pressure wave propagated to the common liquid chamber is propagated to an adjacent individual channel so that mutual interference influencing the liquid occurs, unintentional leakage or ejection of a droplet from the nozzle or instability of an ejection state is induced.

Hence, for example, in an art like described in JP-2011-056924-A, a part of a wall surface of a common liquid chamber is formed as a deformable damper area to attenuate a pressure wave propagated to the common liquid chamber, and a channel plate has such a size that an end surface in a direction perpendicular to a nozzle array direction does not reach the damper area in order to reduce the size thereof.

An attenuation effect (damper performance) produced by the damper area is proportional to a deformation amount (volume change rate) of the damper area, and the deformation amount is proportional to a first power of a long side, a fifth power of a short side and a minus third power of a thickness if the damper area takes a rectangular shape seen on a plane. Accordingly, increasing the short side of the damper area is effective for enhancing the damper performance.

When the short side of the damper area provided on a liquid ejection head has a length in a direction perpendicular to a nozzle array direction and the long side of the damper area has a length in the nozzle array direction, an increase in the short side of the damper area causes an increase in the length (referred to as "head width") in the direction perpendicular to the nozzle array direction of the head, resulting in an increase in the size of the head.

On the other hand, when maintenance and recovery operations are carried out to maintain the performance of the liquid ejection head, a nozzle face of the head is capped with a cap member. In order to reliably carry out the capping of the nozzle face with the cap member, the length (head width) of the short side of the head is increased to secure an area capped by the cap member.

BRIEF SUMMARY

In at least one embodiment of this disclosure, there is provided a liquid ejection head including a nozzle plate, a channel plate, a common-liquid-chamber member, and a deformable damper area. The nozzle plate includes plural nozzles to eject droplets of liquid. The channel plate includes individual liquid chambers communicated with the nozzles. The common-liquid-chamber member includes a common liquid chamber to supply the liquid to the individual liquid chambers. The deformable damper area forms a wall face of the common liquid chamber. The channel plate has an end in a direction perpendicular to a nozzle array direction in which the nozzles are arrayed. The end is opposed to a portion of the damper area and has a relief at a side facing the damper area to permit deformation of the damper area.

In at least one embodiment of this disclosure, there is provided a liquid ejection head including a nozzle plate, a channel plate, a common-liquid-chamber member, and a deformable damper area. The nozzle plate includes plural nozzles to eject droplets of liquid. The channel plate includes plural individual liquid chambers communicated with the nozzles and a liquid introduction portion communicated with the individual liquid chambers. The common-liquid-chamber member includes a common liquid chamber to supply the liquid to the individual liquid chambers. The deformable damper area forms a wall face of the common liquid chamber. The liquid introduction portion has a passage area and a non-opposed area other than the passage area. The passage area has a passage communicated with the common liquid chamber. The non-opposed area is not opposed to the common liquid chamber. The channel plate has a recessed portion not opposed to the damper area in a region in which the non-opposed area of the liquid introduction portion is formed.

In at least one embodiment of this disclosure, there is provided a liquid ejection head including a nozzle plate, a channel plate, a common-liquid-chamber member, and a deformable damper area. The nozzle plate includes plural nozzles to eject droplets of liquid. The channel plate includes plural individual liquid chambers communicated with the nozzles and a liquid introduction portion communicated with the individual liquid chambers. The common-liquid-chamber member includes a common liquid chamber to supply the liquid to the individual liquid chambers. The deformable damper area forms a wall face of the common liquid chamber. The liquid introduction portion has a passage area and a non-opposed area other than the passage area. The passage area has a passage communicated with the common liquid chamber. The non-opposed area is not opposed to the common liquid chamber. The channel plate has an opposed portion opposed to a portion of the damper area in a region in which the non-opposed area of the liquid introduction portion is formed. The opposed portion of the channel plate has a relief at a side facing the damper area to permit deformation of the damper area.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
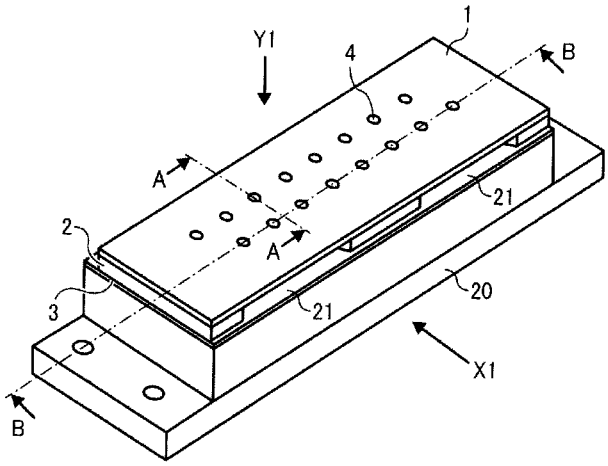
FIG. 1 is a schematic outer perspective view of a liquid ejection head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image fomsation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the embodiments are described with technical limitations with reference to the attached drawings, such description is not intended to limit the scope of the invention and all of the components or elements described in the embodiments of this disclosure are not necessarily indispensable to the present invention.

Referring now to the drawings, wherein like reference numerals designate identical or corresponding parts throughout the several views, embodiments of the present disclosure are described below.

First, a liquid ejection head according to a first embodiment of the present disclosure is described below with reference to FIGS. 1 to 3.

FIG. 1 is a schematic outer perspective view of the liquid ejection head according to the first embodiment. FIG. 2 is a cross sectional view of the liquid ejection head in a direction (long direction of a liquid chamber) perpendicular to a nozzle array direction along an A-A line in FIG. 1. FIG. 3 is a cross sectional view of the liquid ejection head in the nozzle array direction (short direction of the liquid chamber) along a B-B line in FIG. 1.

The liquid ejection head has a nozzle plate 1, a channel plate (chamber substrate) 2, and a diaphragm member 3 serving as a thin film member which are laminated and bonded to each other. The liquid ejection head includes piezoelectric actuators 11 serving as pressure generators to displace the diaphragm member 3 and a frame member 20 serving as a common-liquid-chamber member (common channel member).

The nozzle plate 1, the channel plate 2, and the diaphragm member 3 form individual liquid chambers 6 communicating with plural nozzles 4 to eject droplets, liquid supply channels 7 serving as fluid resistance portions to supply liquid to the individual liquid chambers 6, and liquid introduction portions 8 communicating with the corresponding liquid supply channels 7. The individual liquid chambers 6 are also referred to as pressure chambers, pressurized liquid chambers, pressurized chambers, pressure generation chambers or the like.

Liquid is supplied from a common liquid chamber 10 serving as a common channel of the frame member 20 to the individual liquid chambers 6 via the liquid introduction portions 8 and the liquid supply channels 7 through openings 9 formed in the diaphragm member 3. A filter is provided on each of the openings 9 of the diaphragm member 3.

The nozzle plate 1 is formed by a metal plate of nickel (Ni) according to, e.g., an electroforming method (electrocasting). The nozzle plate 1 is not limited to the metal plate of nickel and may be formed of, e.g., another metal member, a resin member, or a laminated member including a resin layer and a metal layer. The nozzle plate 1 has the nozzles 4 having a diameter of, e.g., 10 μm to 35 μm and formed corresponding to the respective individual liquid chambers 6. The nozzle plate 1 is bonded to the channel plate 2 with an adhesive. Moreover, a liquid repellent layer is provided on a droplet-ejection-side surface (a surface in an ejection direction: an ejection face or an opposite surface to the individual liquid chamber 6 side) of the nozzle plate 1.

The channel plate 2 has groove portions formed by etching a single crystal silicon substrate, and each of the groove portions constitutes, e.g., the individual liquid chamber 6, the liquid supply channel 7, and the liquid introduction portion 8 The channel plate 2 can also be formed by etching a metal plate such as a stainless steel (SUS) substrate with an acidic etching liquid or carrying out a machining work such as pressing.

In this embodiment, the diaphragm member 3 serves as a wall surface member forming the wall surface of the individual liquid chamber 6 of the channel plate 2 and has a two-layer structure including a first layer 3A and a second layer 3B. Alternatively, the diaphragm member 3 may have a structure including at least three layers or a single-layer structure. Here, a deformable vibration area 30 is provided in a corresponding part to the individual liquid chamber 6 by the first layer 3A of the diaphragm member 3.

Each piezoelectric actuator 11 including an electromechanical transducer is disposed at a side of the diaphragm member 3 opposite to the corresponding individual liquid chamber 6. The electromechanical transducer serves as a driving unit (actuator or pressure generator) to deform the vibration area 30 of the diaphragm member 3.

The piezoelectric actuator 11 is obtained by performing grooving through half-cut dicing over a piezoelectric member 12 of a lamination type which is bonded onto a base member 13 with an adhesive, thereby forming a predetermined number of pillar-shaped piezoelectric elements (piezoelectric pillars) 12A and 12B like a comb tooth at a certain interval.

Although the piezoelectric pillars 12A and 12B of the piezoelectric member 12 are identical to each other, they are distinguished by setting, as a driving piezoelectric pillar (a driving pillar) 12A, a piezoelectric pillar for applying a driving waveform to carry out driving and, as a non-driving piezoelectric pillar (a non-driving pillar) 12B, a piezoelectric pillar to be used as a simple support without the application of the driving waveform.

The driving pillar 12A is bonded to an island-shaped projection 3*a* formed in the vibration area 30 of the diaphragm member 3 by the second layer 3B, and the non-driving pillar 12B is bonded to a projection 3*b* of the diaphragm member 3.

The piezoelectric member 12 is obtained by alternately laminating piezoelectric layers and internal electrodes. The internal electrodes are led out to end surfaces of the piezoelectric member 12 to form external electrodes of the piezoelectric member 12, and a flexible printed circuit (FPC) 15 is connected to the piezoelectric member 12. The FPC 15 serves as a flexible wiring board to supply driving signals to the external electrodes of the driving pillar 12A.

The frame member 20 is formed by injection molding with, e.g., an epoxy resin or a thermoplastic resin, such as polyphenylene sulfite, and includes the common liquid chamber 10 to which liquid is supplied from a head tank or a liquid cartridge.

In a wall surface of a part of the common liquid chamber 10, the first layer 3A constituting the diaphragm member 3 is used as a damper member and serves as a damper area 21 serving as a deformable area formed by the first layer 3A.

For the liquid ejection head thus configured, for example, a voltage to be applied to the driving pillar 12A is reduced from a reference potential so that the driving pillar 12A contracts and the vibration area 30 of the diaphragm member 3 is moved downward to increase the volume of the individual liquid chamber 6. Consequently, the liquid flows into the individual liquid chamber 6. Then, the voltage to be applied to the driving pillar 12A is raised to extend the driving pillar 12A in a lamination direction, and the vibration area 30 of the diaphragm member 3 is deformed in a direction of the nozzle 4 to reduce the volume of the individual liquid chamber 6. Thus, the liquid in the individual liquid chamber 6 is pressurized so that a droplet is ejected (jetted) from the nozzle 4.

The voltage to be applied to the driving pillar 12A is returned to the reference potential so that the vibration area 30 of the diaphragm member 3 is restored to an initial position and the individual liquid chamber 6 expands to generate a negative pressure. At this time, the liquid is replenished into the individual liquid chamber 6 from the common liquid chamber 10 via the liquid supply channel 7. After the vibration of a meniscus face of the nozzle 4 is attenuated and stabilized, the process shifts to the next operation for ejecting a droplet.

The method of driving the head is not restricted to the above-described example (pull ejection-push ejection) and, e.g., pull ejection or push ejection may be performed by changing a way of applying a driving waveform.

Next, a relationship between the damper area and the channel plate according to the present embodiment is described with reference to FIGS. 4 and 5.

Figure 2:
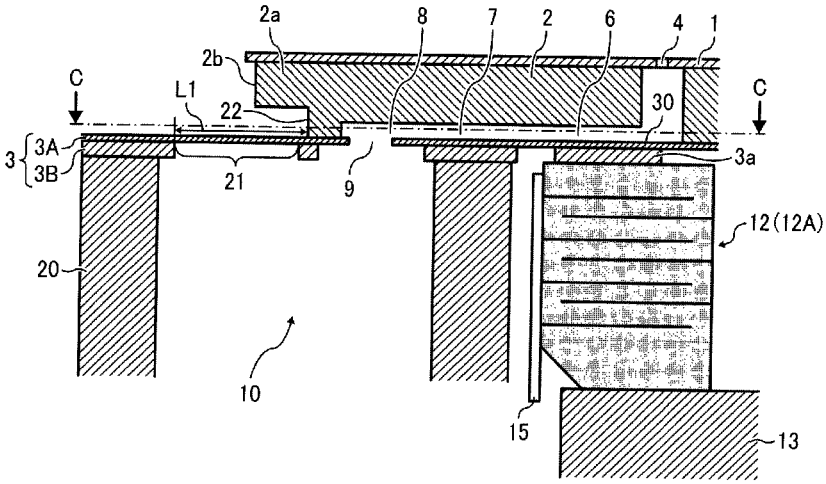
FIG. 2 is a cross-sectional view of the liquid ejection head in a direction (long direction of a liquid chamber) perpendicular to a nozzle array direction along an A-A line in FIG. 1.
Figure 3:
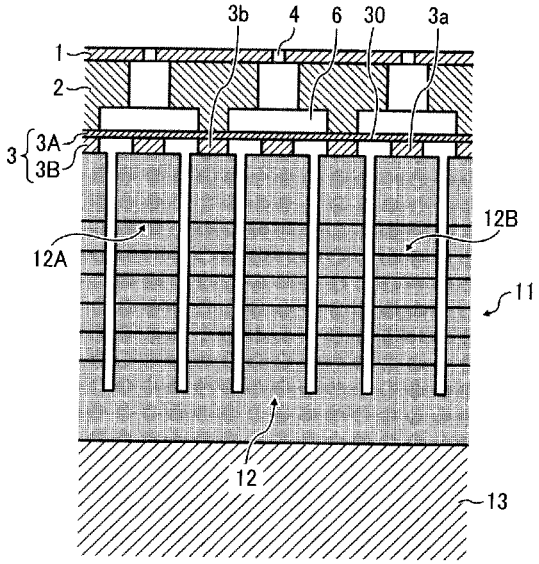
FIG. 3 is a cross-sectional view of the liquid ejection head in the nozzle array direction (short direction of the liquid chamber) along a B-B line in FIG. 1.
Figure 4:
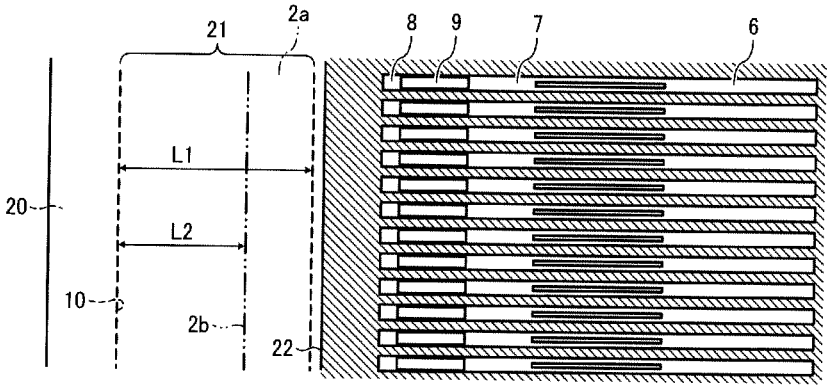
FIG. 4 is a cross-sectional view of the liquid ejection head taken along a C-C line in FIG. 2 which is to be used for explaining a relationship between a damper area and a channel plate.
Figure 5:
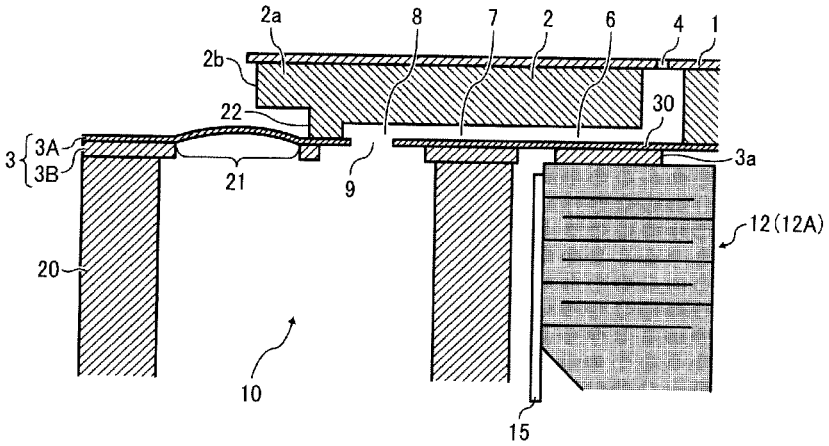
FIG. 5 is a cross-sectional view of the liquid ejection head in a state in which the damper area is deformed outward (in a direction opposite to a common liquid chamber)

FIG. 4 is a cross sectional view of the liquid ejection head cut along a C-C line in FIG. 2. FIG. 5 is a cross sectional view of the liquid ejection head in a state in which the damper area is deformed outward (i.e., in a direction opposite to the common liquid chamber).

In the liquid ejection head, an end 2*a* in the direction perpendicular to the nozzle array direction of the channel plate 2 is opposed to a part of the damper area 21.

A relief 22 is formed at a portion of the end 2*a* of the channel plate 2 opposed to the damper area 21. The relief 22 permits the deformation of the damper area 21 (see FIG. 5).

At this time, in a case in which a droplet ejection direction is set as an upward direction, an end surface 2*b* of the end 2*a* of the channel plate 2 in the direction perpendicular to the nozzle array direction is located above the damper area 21.

The relief 22 is formed in a shape of a step from the diaphragm member 3 (damper member) side as seen on a section in a liquid supply direction from the common liquid chamber 10.

Here, an external shape of the channel plate 2 in the nozzle array direction is described with reference to FIG. 6.

Figure 6A:
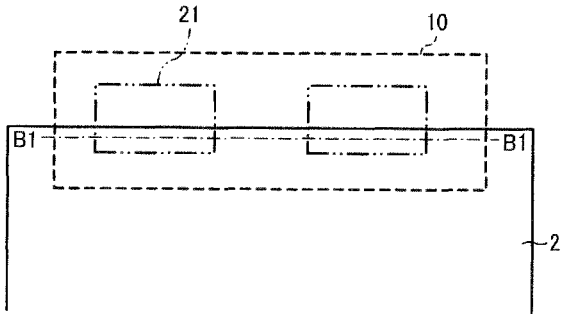
FIGS. 6A to 6C are schematic views of the liquid ejection head.
Figure 6B:
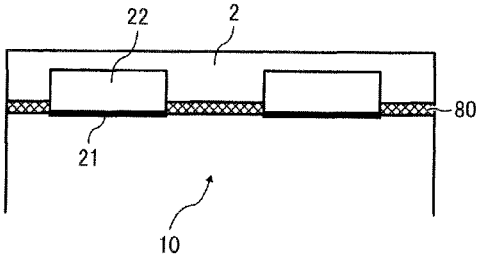

FIG. 6A is a schematic plan view of the liquid ejection head seen from a direction of an arrow Y1 in FIG. 1. FIG. 6B is a schematic cross sectional view of a portion of the liquid ejection head taken along a line B1-B1 of FIG. 6A as seen from a direction of an arrow X1 in FIG. 1.

For the external shape of the channel plate 2 in the nozzle array direction, the relief 22 taking the shape of the step is formed in an opposed area to the damper area 21 and the relief 22 is not formed in an opposed area to a portion in which the damper area 21 is not formed so that the channel plate 2 is bonded to the diaphragm member 3 with an adhesive 80.

Such a configuration can securely obtain a bonded area of the channel plate 2 and the diaphragm member 3 in a place in which the damper area 21 is not formed.

Thus, the relief 22 is provided on the end 2*a* of the channel plate 2, and the end 2*a* of the channel plate 2 is opposed to a part of the damper area 21. Such a configuration allows an increase in the width of the damper area 21 without reducing the length of the channel plate 2 in the direction perpendicular to the nozzle array direction (hereinafter referred to as "length" or "width" in a short side direction of the channel plate 2).

In other words, the relief 22 is provided on a part interfering with the damper area 21 over the channel plate 2. Consequently, such a configuration can enlarge the damper area 21 without interference of the channel plate 2 and the damper area 21 and change the size of the whole head.

Here, a comparative example 1 is described with reference to FIGS. 7 and 8.

Figure 7:
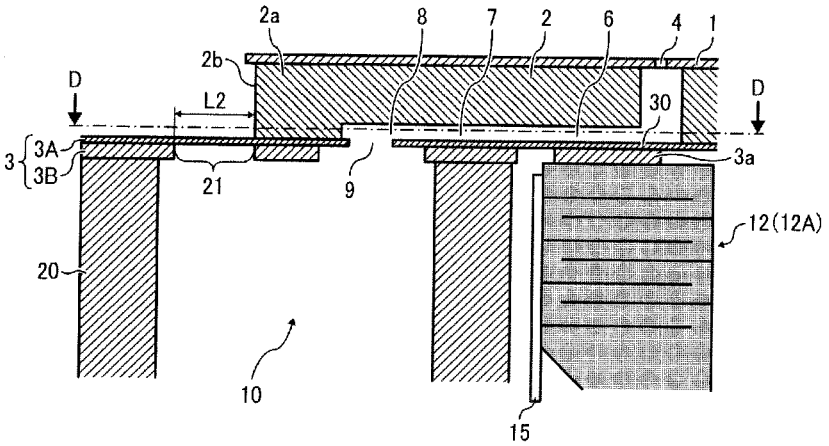
FIG. 7 is a cross-sectional view of a liquid ejection head according to a comparative example 1.
Figure 8:
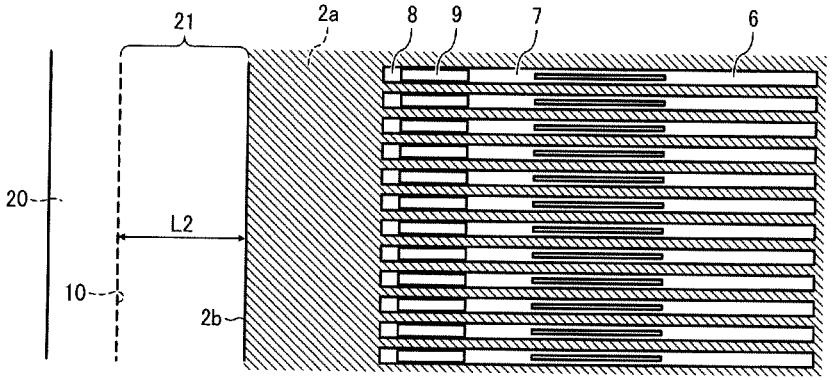
FIG. 8 is a cross-sectional view of the liquid ejection head taken along a D-D line in FIG. 7.

FIG. 7 is a cross sectional view of a liquid ejection head according to the comparative example 1. FIG. 8 is a cross sectional view of the liquid ejection head taken along a D-D line of FIG. 7.

The comparative example 1 employs a structure in which the end surface 2*b* of the end 2*a* does not reach the damper area 21 in such a manner that the end 2*a* of the channel plate 2 is not opposed to the damper area 21.

In the comparative example 1, if a width L2 of the damper area 21 is set to be equal to the width of the channel plate 2 so as to be increased, the damper area 21 is extended toward an opposite side to the nozzle side in the direction perpendicular to the nozzle array direction so that the size of the head is increased. On the other hand, the width of the channel plate 2 is reduced in order to increase the width L2 of the damper area 21 with the width of the head maintained.

On the other hand, according to the present embodiment, a width L1 of the damper area 21 can be greater than the width L2 of the damper area 21 according to the comparative example 1 (a length to the end surface 2*b* of the end 2*a* of the channel plate 2) as shown in FIG. 2.

Consequently, if the width of the damper area 21 is set to be, e.g., 1.2 times as great as an original length, the deformation amount can be increased by approximately 2.5 fold because the deformation amount of the damper area 21 is proportional to a fifth power of the width (length of the short side) of the damper area 21.

Figure 9:
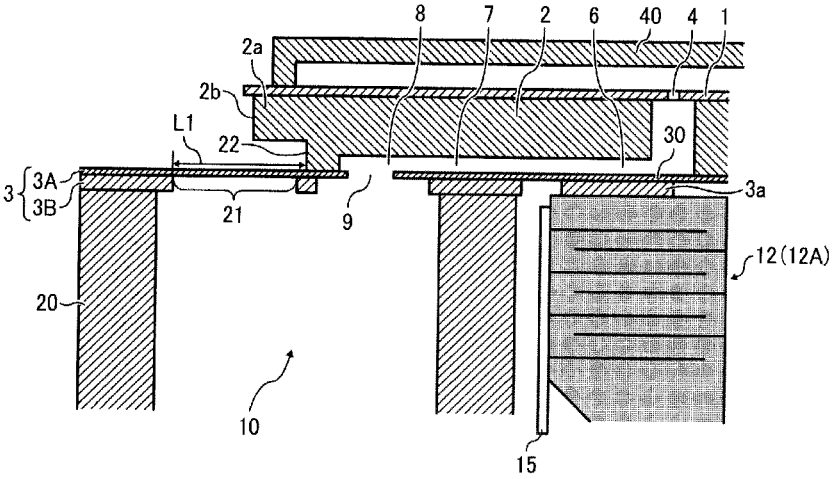
FIG. 9 is a cross-sectional view of the liquid ejection head in a capping state according to the first embodiment.

In the liquid ejection head according to the present embodiment, moreover, the widths of the nozzle plate 1 and the channel plate 2 are not reduced. Accordingly, as shown in FIG. 9, a capping area formed by a cap member 40 for maintenance and recovery can be secured, thus preventing a reduction in the capping performance.

Figure 10:
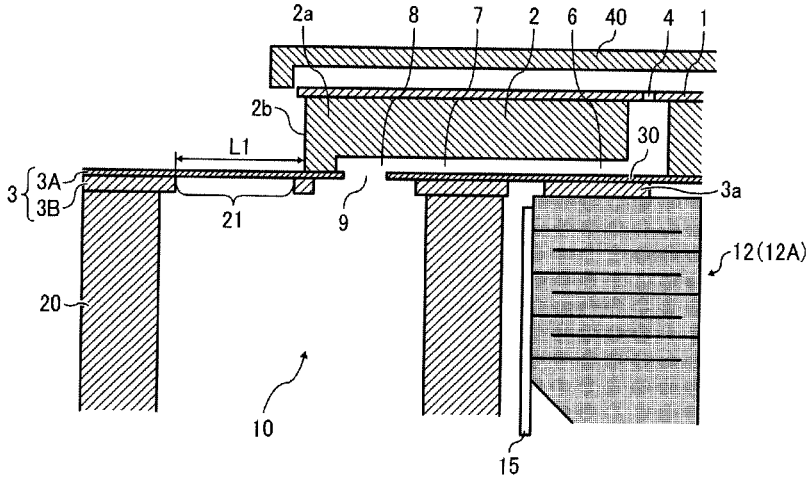
FIG. 10 is a cross-sectional view of the liquid ejection head in a capping failure according to the comparative example 1.

On the other hand, with the structure according to the comparative example 1, the widths of the channel plate 2 and the nozzle plate 1 are reduced in order to maintain the width L1 of the damper area 21 which is the same as that in the present embodiment with the width of the head made equal. For this reason, the size of the capping area formed by the cap member 40 is reduced as shown in FIG. 10. When the size of the capping area is reduced, a capping failure is more likely to occur. If the capping failure occurs, ink in the nozzle 4 might dry during standby of the head, thus causing non-ejection of droplets and preventing formation of high-quality image output.

Figure 11:
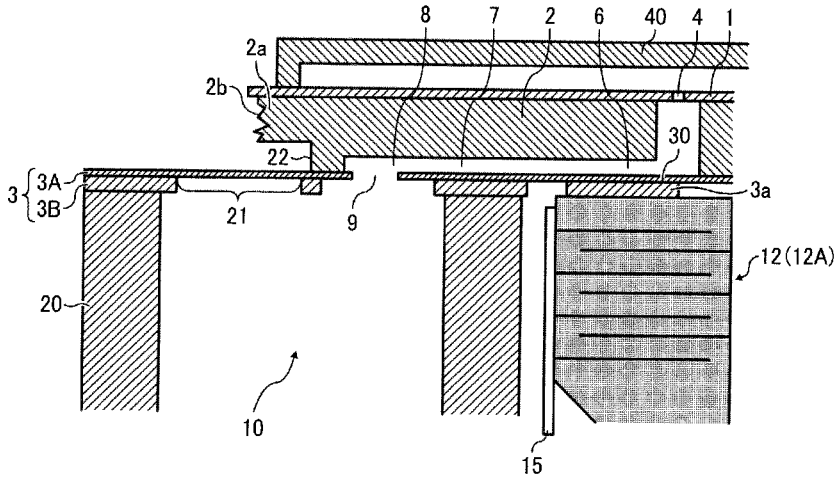
FIG. 11 is a cross-sectional view of the liquid ejection head to be used for explaining a finishing state of an end surface of the channel plate and an influence on the damper area according to the first embodiment.

For the liquid ejection head according to the present embodiment, furthermore, the end surface 2*b* of the channel plate 2 in which the relief 22 is formed does not come in contact with a bonded part to the damper area 21, thus allowing a reduction in the precision in the external shape of the channel plate 2. In other words, as shown in FIG. 11, providing the relief 22 can reduce the possibility of the interference with the damper area 21 even if working precision in the end surface 2*b* of the channel plate 2 is low.

Figure 12:
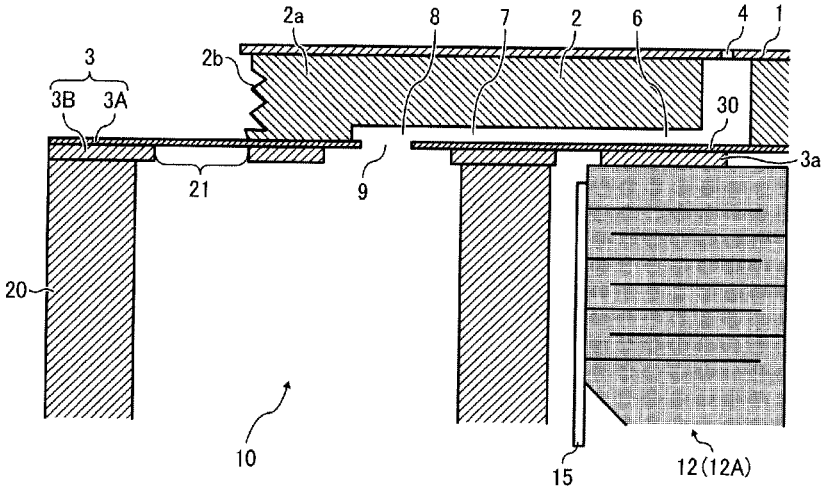
FIG. 12 is a cross-sectional view of the liquid ejection head to be used for explaining an influence of the finishing state of the end surface of the channel plate on the damper area according to the comparative example 1.

On the other hand, with the structure according to the comparative example 1, there is a possibility that the end surface 2*b* of the channel plate 2 might interfere with the damper area 21 depending on a position of the bonded part to the diaphragm member 3 if the precision in the end surface 2*b* of the channel plate 2 is low as shown in FIG. 12. If they interfere with each other, the damper area 21 is prevented from being deformed so that damper performance is deteriorated.

When a size of the damper area is increased as in the present embodiment, moreover, the strength of the damper area formed by a thin member might be reduced, thus increasing the breakage risk of a damper. For example, the liquid ejection head is disposed close to a recording sheet. For this reason, the damper area also becomes close to the recording sheet. If the recording sheet interferes with the damper area, the damper having a small strength might be damaged. For this reason, it is conceivable to separately provide an assembly for protecting the damper area, for example, a nozzle cover. In the present embodiment, however, the end of the channel plate is opposed to the damper area. Even if the protection assembly is not provided separately, therefore, the interference with the recording sheet can be reduced. In the present embodiment, furthermore, it is possible to efficiently reduce the breakage risk of the damper by opposing, to the end of the channel plate, only the vicinity of the end where stress concentration occurs to readily cause the breakage in the damper area.

In addition, the relief of the channel plate according to the present embodiment is set to be an engagement portion with a member for holding the channel plate (a channel plate holding member) when the channel plate and the nozzle plate are aligned and bonded to each other. Such a configuration can obtain bonding with high precision.

Figure 13:
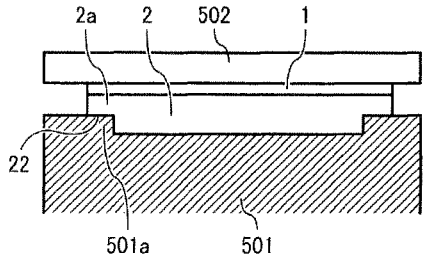
FIG. 13 is a schematic view of the liquid ejection head to be used for explaining an operation effect according to the first embodiment.

For example, as shown in FIG. 13, a surface of a channel plate holding member 501 is provided with a projection 501*a*. The surface of the channel plate holding member 501 abuts on a surface of the channel plate 2 where the relief 22 is formed. The projection 501*a* is engaged with the relief 22 (a concave shape) of the channel plate 2. In a state in which the projection 501*a* of the channel plate holding member 501 and the relief 22 are aligned to be engaged with each other and the channel plate 2 is thus provided on the channel plate holding member 501, the nozzle plate 1 is aligned with the channel plate 2 and they are pressurized by a pressure member 502 and are thus bonded to each other with an adhesive.

As a result, an external surface of the channel plate 2 abuts on the channel plate holding member 501 and is fixed thereto, and furthermore, is bonded to the nozzle plate 1 in a state in which the relief 22 and the projection 501*a* of the channel plate holding member 501 are engaged with each other. Such a configuration allows the channel plate 2 to be bonded to the nozzle plate 1 with high precision.

As described above, in the present embodiment, the end in the direction perpendicular to the nozzle array direction of the channel plate is opposed to a part of the damper area, and the relief for permitting the deformation of the damper area is provided at the damper area side in the opposed portion to the damper area in the channel plate. Such a configuration can maintain the capping area and enhance the damper performance while preventing an increase in the size of the whole head.

In such a case, the damper member forming the damper area can also be formed by a resin material or the like. By fabricating the damper member with the same member as the diaphragm member as in the present embodiment, however, the number of components can be reduced to reduce cost.

Figure 6C:
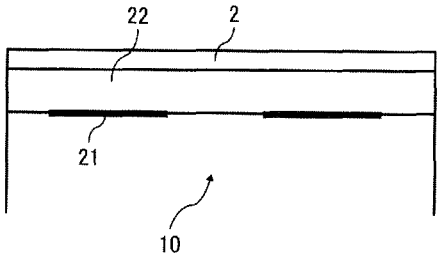

In the above-described embodiment, the relief 22 is not formed in an opposed place to the area in which the damper area 21 is not formed. However, the relief 22 may be formed across the whole area in the nozzle array direction of the channel plate 2 as shown in FIG. 6C. FIG. 6C is a schematic cross sectional view similar to FIG. 6B.

Next, an example of a method of manufacturing the liquid ejection head according to the first embodiment is described below with reference to FIGS. 14A to 14C.

Figure 14A:
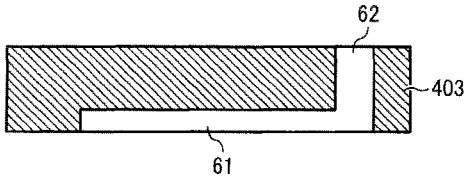
FIGS. 14A to 14C are cross-sectional views of an example of a method of manufacturing the liquid ejection head according to the first embodiment.
Figure 14B:
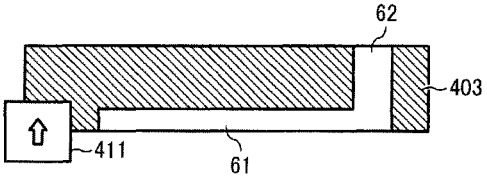
Figure 14C:
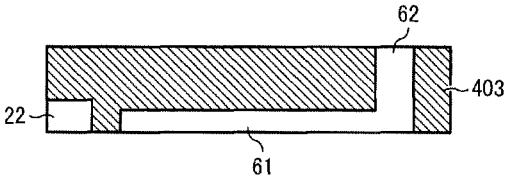

FIGS. 14A to 14C is a cross sectional view of the liquid ejection head illustrated for explaining the manufacturing method.

In the manufacturing method, as shown in FIG. 14A, an intermediate member 403 is obtained. The intermediate member 403 has an individual channel 61 and a passage 62 formed thereon. The individual channel 61 serves as a channel formed of the individual liquid chamber 6, the liquid supply channel 7 and the liquid introduction portion 8, and the passage 62 communicates the individual channel 61 with the nozzle 4.

As shown in FIG. 14B, a pressing work is carried out by a punch 411 over a portion of the intermediate member 403 which serves as the relief 22. As a result, as shown in FIG. 14C, the channel plate 2 having the relief 22 is obtained. In this case, the intermediate member 403 is a metal member.

Next, another example of the method of manufacturing the liquid ejection head according to the first embodiment is described below with reference to FIG. 15.

Figure 15:
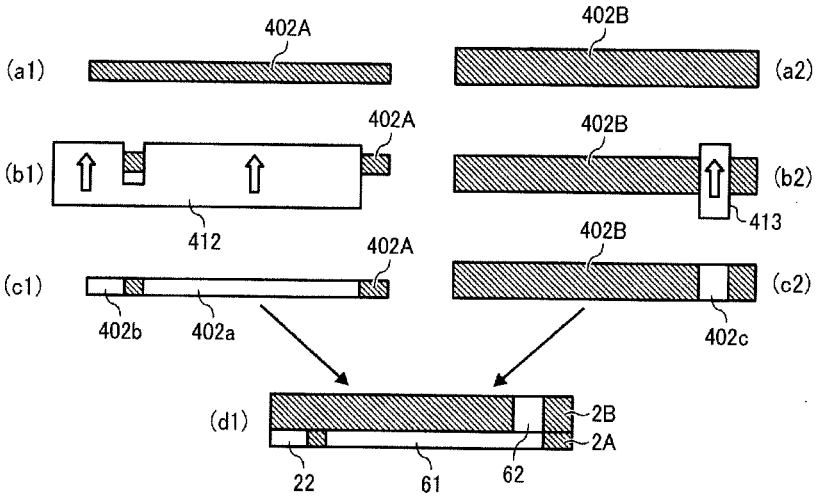
FIG. 15 is a cross-sectional view of another example of the method of manufacturing the liquid ejection head according to the first embodiment.

FIG. 15 is a cross sectional view of the liquid ejection head illustrated for explaining the manufacturing method.

As shown in b1 of FIG. 15, a pressing work (a punching work) is carried out by a punch 412 on a first substrate 402A where the individual channel 61 and the relief 22 are to be formed as illustrated in a1 of FIG. 15. As shown in e1 of FIG. 15, thus, there is obtained a first channel plate 2A where a through hole 402*a* serving as the individual channel 61 and a through hole 402*b* serving as the relief 22 are formed. On the other hand, as shown in b2 of FIG. 15, the pressing work (the punching work) is carried out by the punch 412 on a second substrate 402B where the passage 62 is to be formed as illustrated in a2 of FIG. 15. As a result, as shown in c2 of FIG. 15, a second channel plate 2B having a through hole 402*c* serving as the passage 62 is obtained.

Then, the first channel plate 2A and the second channel plate 2B are bonded to each other to obtain the channel plate 2 having the individual channel 61, the relief 22 and the passage 62 formed thereon as shown in d1 of FIG. 15.

In other words, as in the present embodiment, the relief can be formed by the pressing work when the relief 22 of the channel plate 2 takes a shape of a vertical step as seen on a section in the liquid supply direction from the common liquid chamber 10. By constituting the channel plate 2 from two members or more, the individual channel and the relief can be simultaneously formed by the punching work.

Next, a liquid ejection head according to a second embodiment of the present disclosure is described below with reference to FIG. 16.

Figure 16:
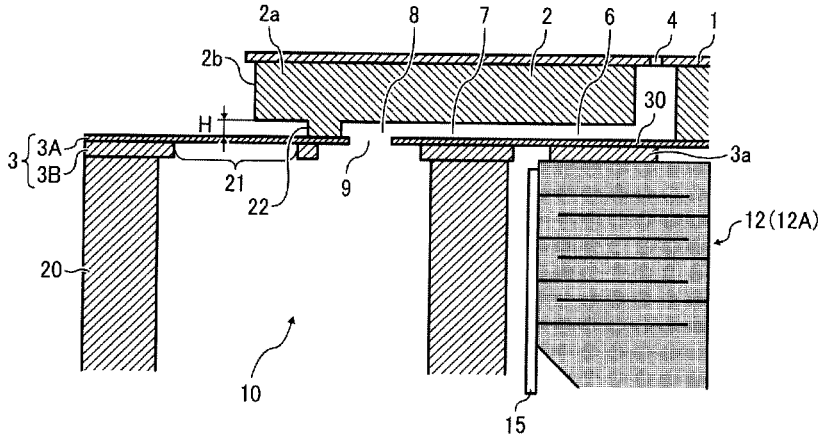
FIG. 16 is a cross-sectional view of a liquid ejection head according to a second embodiment of the present disclosure.

FIG. 16 is a cross sectional view of the liquid ejection head according to the second embodiment.

In the present embodiment, a height H of a relief 22 of a channel plate 2 is set to be equal to a height of an individual liquid chamber 6.

In the case in which the channel plate 2 is fabricated by etching or a punching work, consequently, it is possible to form the relief 22 and an individual channel 61 including the individual liquid chamber 6 in the same process. In the present embodiment, the individual channel 61 is formed of the individual liquid chamber 6, a liquid supply channel 7 and a liquid introduction portion 8.

Next, an example of a method of manufacturing the liquid ejection head according to the second embodiment is described below with reference to FIGS. 17A to 17C.

Figure 17A:
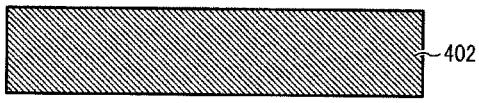
FIGS. 17A to 17C are cross-sectional views of an example of a method of manufacturing the liquid ejection head according to the second embodiment.
Figure 17B:
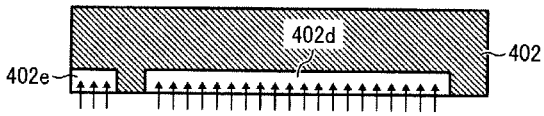
Figure 17C:
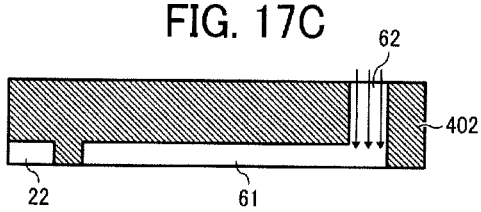

In this manufacturing method, in a substrate 402 serving as the channel plate 2 illustrated in FIG. 17A, as shown in FIG. 17B, etching is carried out on portions serving as the relief 22 and the individual channel 61 to form dug portions 402*d* and 402*e*. As shown in FIG. 17C, the relief 22 and the individual channel 61 are formed, and furthermore, a passage 62 communicating with a nozzle 4 is formed.

Next, a liquid ejection head according to a third embodiment of the present disclosure is described below with reference to FIG. 18.

Figure 18:
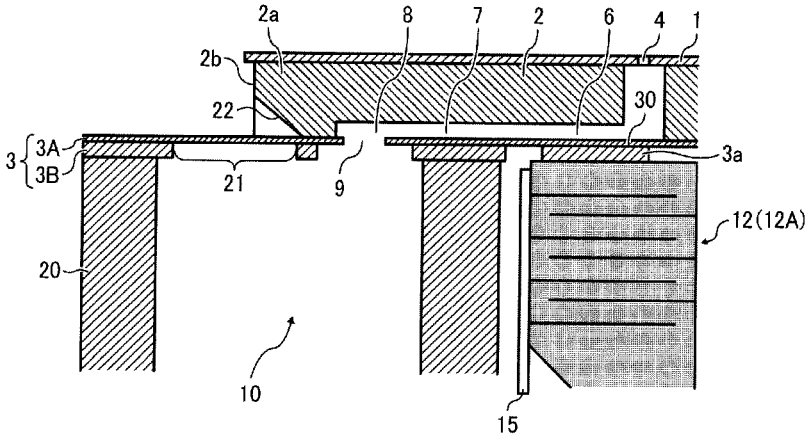
FIG. 18 is a cross-sectional view of a liquid ejection head according to a third embodiment of the present disclosure.

FIG. 18 is a cross sectional view of the liquid ejection head according to the third embodiment.

In the present embodiment, a relief 22 of a channel plate 2 takes a taper shape in which the relief 22 is gradually inclined in a separating direction from a damper area 21 in a direction perpendicular to a nozzle array direction as seen on a section in a liquid supply direction from a common liquid chamber 10.

Next, an example of a method of manufacturing the liquid ejection head according to the third embodiment is described below with reference to FIGS. 19A to 19C.

Figure 19A:
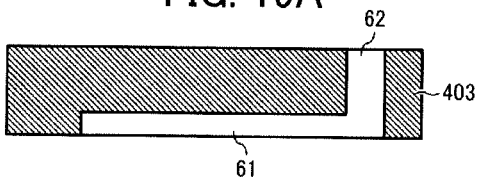
FIGS. 19A to 19C are cross-sectional views of an example of a method of manufacturing the liquid ejection head according to the third embodiment.
Figure 19B:
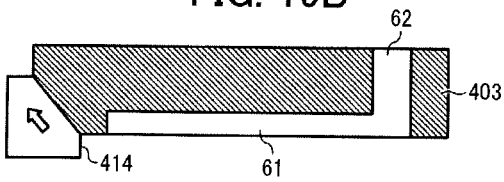
Figure 19C:
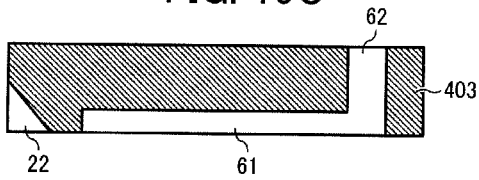

As shown in FIG. 19B, chamfering is carried out by a processing unit 414 on a part to be the relief 22 of an intermediate member 403 having an individual channel 61 and a passage 62 formed therein as illustrated in FIG. 19A. Thus, as shown in FIG. 19C, the channel plate 2 having the relief 22 is obtained.

Next, a liquid ejection head according to a fourth embodiment of the present disclosure is described below with reference to FIG. 20.

Figure 20:
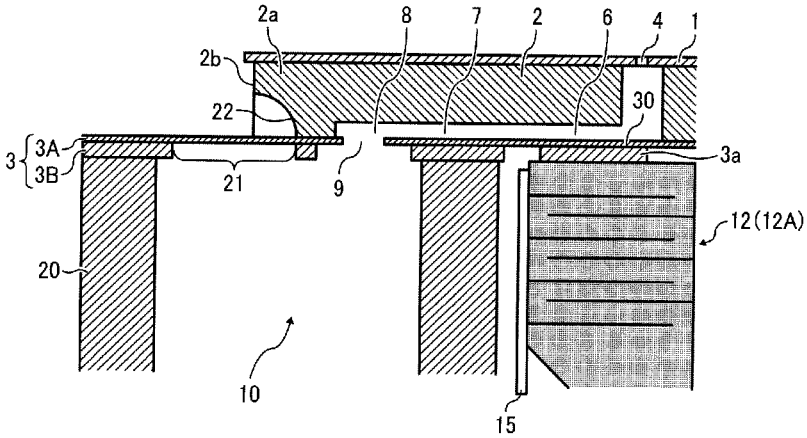
FIG. 20 is a cross-sectional view of a liquid ejection head according to a fourth embodiment of the present disclosure.

FIG. 20 is a cross sectional view of the liquid ejection head according to the fourth embodiment.

In the present embodiment, a relief 22 of a channel plate 2 takes a round shape in which the relief 22 is gradually separated from a damper area 21 in a direction perpendicular to a nozzle array direction as seen on a section in a liquid supply direction from a common liquid chamber 10.

Next, an example of a method of manufacturing the liquid ejection head according to the fourth embodiment is described below with reference to FIG. 21.

Figure 21A:
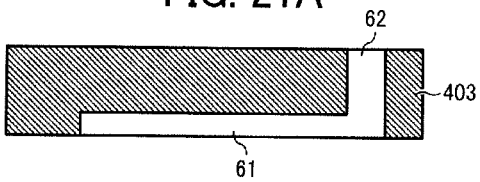
FIGS. 21A to 21C are cross-sectional views of an example of a method of manufacturing the liquid ejection head according to the fourth embodiment.
Figure 21B:
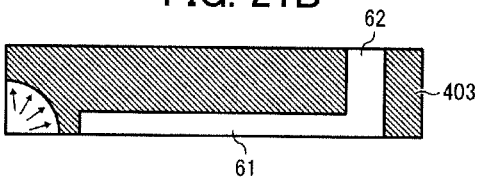
Figure 21C:
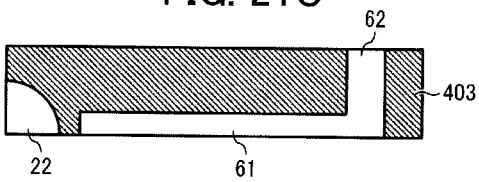

As shown in FIG. 21B, isotropic etching is carried out on a part to be the relief 22 of an intermediate member 403 having an individual channel 61 and a passage 62 formed therein as illustrated in FIG. 21A. Thus, as shown in FIG. 21C, the channel plate 2 having the relief 22 is obtained.

Next, a liquid ejection head according to a fifth embodiment of the present disclosure is described below with reference to FIGS. 22 and 23.

Figure 22:
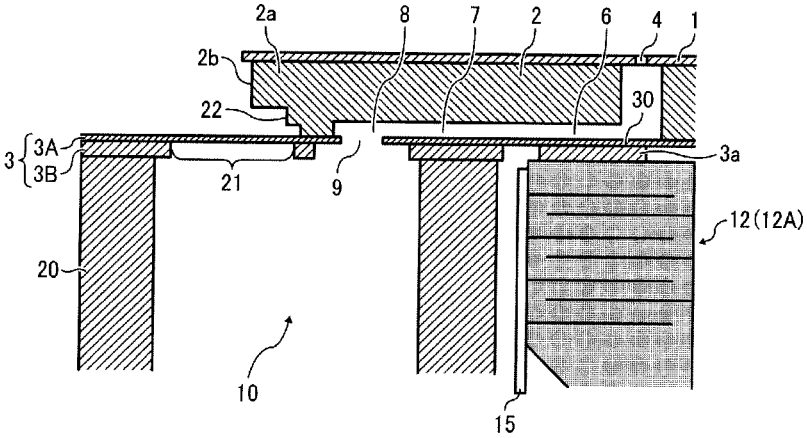
FIG. 22 is a cross-sectional view of a liquid ejection head according to a fifth embodiment of the present disclosure.
Figure 23:
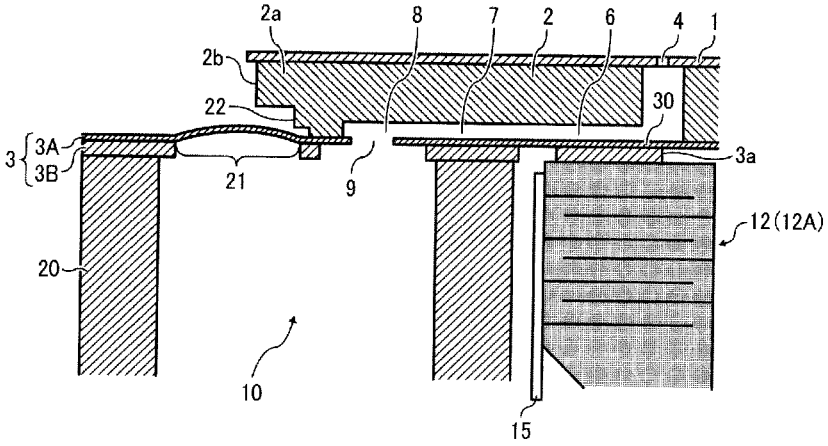
FIG. 23 is a cross-sectional view of the liquid ejection head according to the fifth embodiment in a state in which a damper area is deformed.

FIG. 22 is a cross sectional view of the liquid ejection head according to the fifth embodiment. FIG. 23 is a cross sectional view of the liquid ejection head in a state in which a damper area is deformed.

In the present embodiment, a relief 22 of a channel plate 2 takes a vertical step shape having two stages which are stepwisely separated from a damper area 21 in a direction perpendicular to a nozzle array direction as seen on a section in a liquid supply direction from a common liquid chamber 10. As described above, in the present embodiment, the relief 22 has a vertical step shape having two stages. However, in other embodiments, the relief may have three or more stages.

Such a configuration suppresses interference of the damper area 21 with an end 2*a* of the channel plate 2 when the damper area 21 is deformed.

Next, a liquid ejection head according to a sixth embodiment of the present disclosure is described below with reference to FIGS. 24 and 25.

Figure 24:
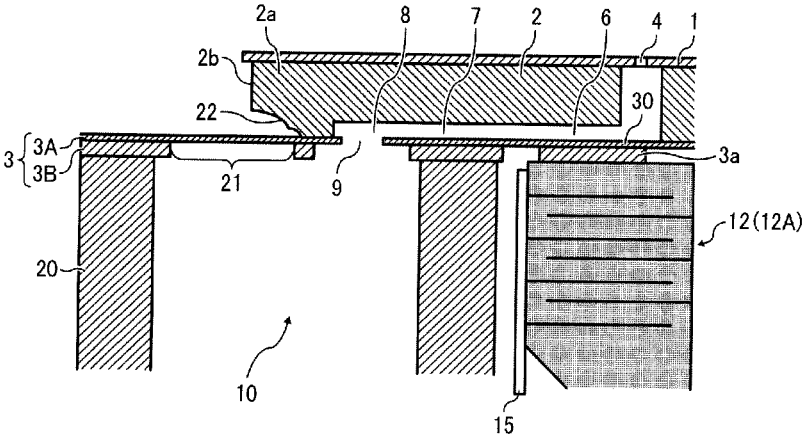
FIG. 24 is a cross-sectional view of a liquid ejection head according to a sixth embodiment of the present disclosure.
Figure 25:
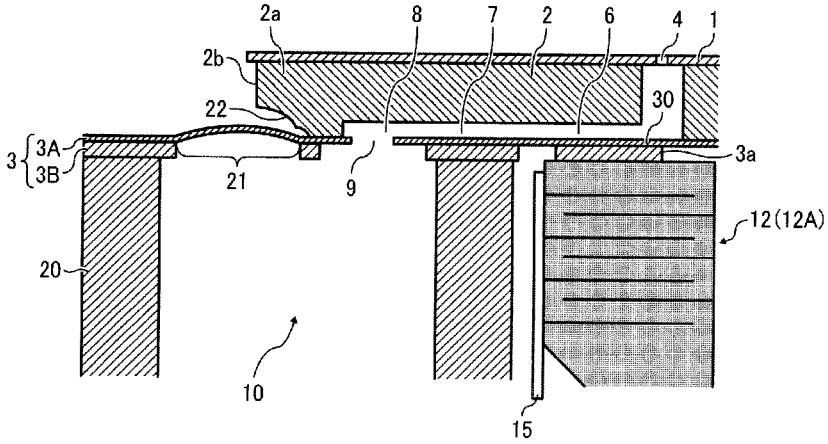
FIG. 25 is a cross-sectional view of the liquid ejection head according to the sixth embodiment in a state in which a damper area is deformed.

FIG. 24 is a cross sectional view of the liquid ejection head according to the sixth embodiment. FIG. 25 is a cross sectional view of the liquid ejection head in a state in which a damper area is deformed.

In the present embodiment, a relief 22 of a channel plate 2 takes a round shape having two stages (or three or more stages) which are stepwise separated from a damper area 21 in a direction perpendicular to a nozzle array direction as seen on a section in a liquid supply direction from a common liquid chamber 10.

Such a configuration suppresses interference of the damper area 21 with an end 2*a* of the channel plate 2 when the damper area 21 is deformed.

Next, a liquid ejection head according to a seventh embodiment of the present disclosure is described below with reference to FIG. 26.

Figure 26:
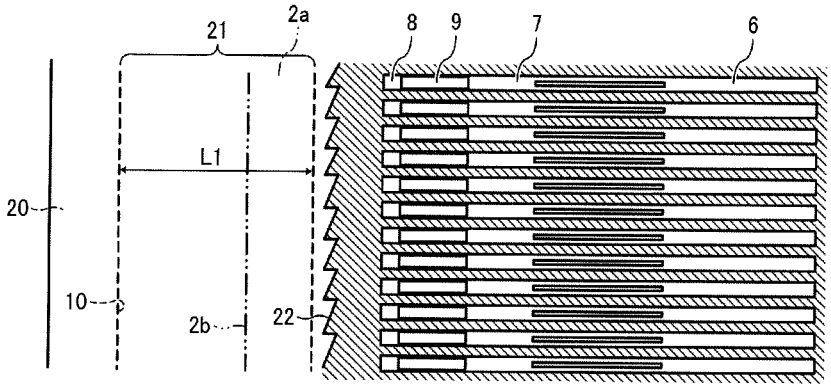
FIG. 26 is a cross-sectional view of a liquid ejection head according to a seventh embodiment of the present disclosure.

FIG. 26 is a cross sectional view of the liquid ejection head according to the seventh embodiment.

In the present embodiment, a wall surface 2*c* forming a boundary between a relief 22 of a channel plate 2 and a damper area 21 takes a shape of a sawtooth.

By taking the shape of the sawtooth, the channel plate 22 having the relief 22 can be fabricated from a material having anisotropy, for example, silicon.

Next, different examples of the arrangement in which a large number of channel plates are fabricated from a material is described below with reference to FIGS. 27 and 28.

Figure 27:
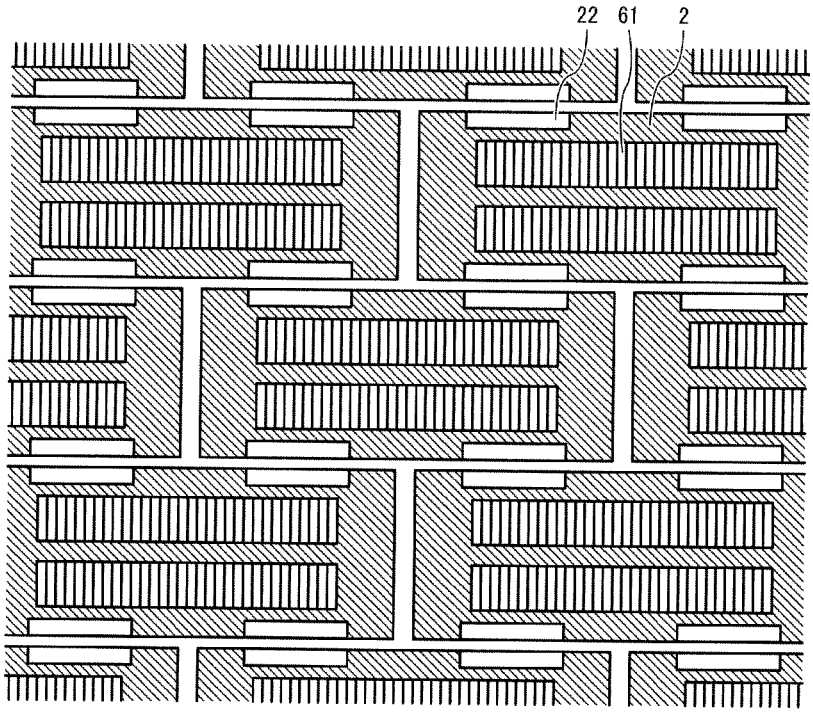
FIG. 27 is a plan view of an example of an arrangement in which a large number of channel plates are provided.
Figure 28:
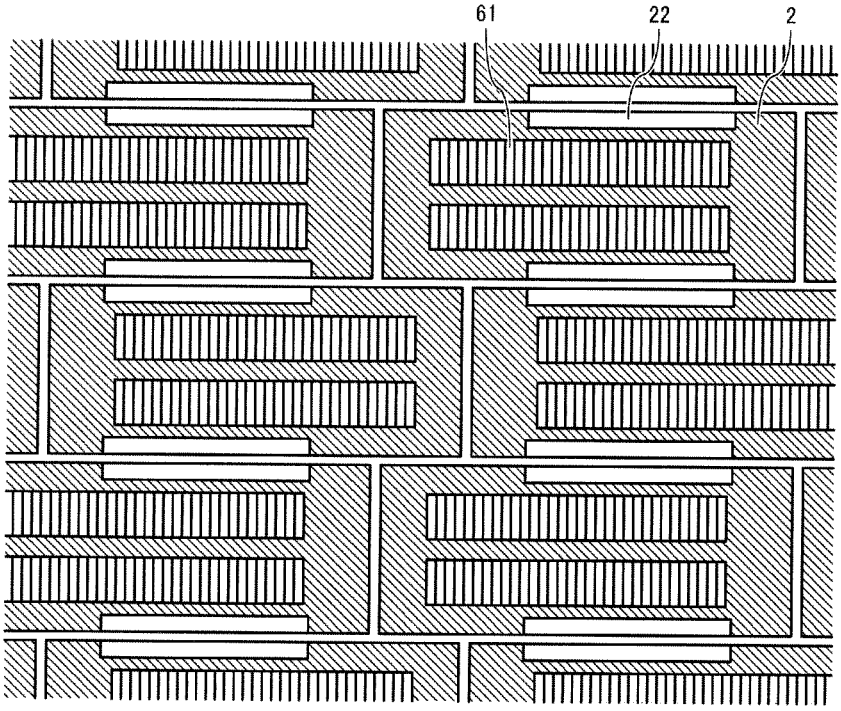
FIG. 28 is a plan view of another example of an arrangement in which a large number of channel plates are provided.

FIGS. 27 and 28 are views of channel plates 2 seen from a face of each channel plate to be bonded to a diaphragm member.

As shown in FIG. 27, relieves 22 of the channel plates 2 may be disposed opposing to each other. Collecting processing parts in a single place allows a reduction in the number of processing steps. Alternatively, the reliefs 22 are not arranged in four corners of each channel plate 2 but may also be disposed in two places as shown in FIG. 28 so that the relieves 2 in each channel plate 2 are not opposed to each other.

Next, a liquid ejection head according to an eighth embodiment of the present disclosure is described below with reference to FIGS. 29 and 30.

Figure 29:
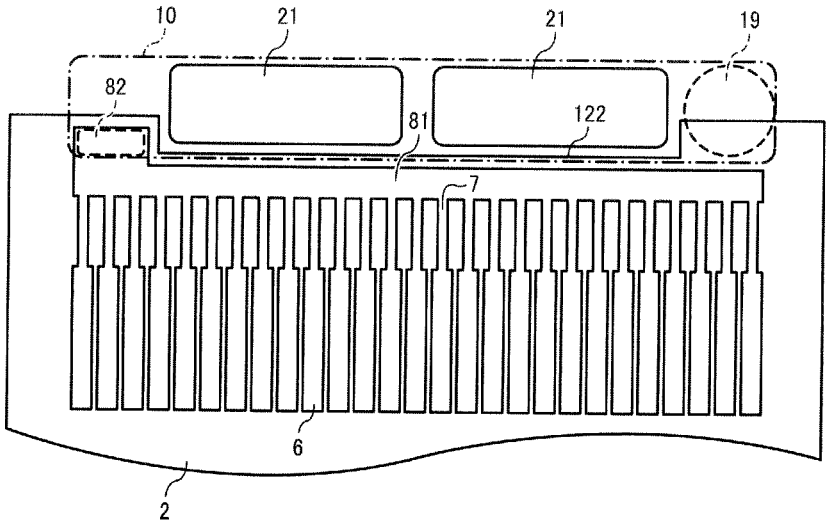
FIG. 29 is a cross-sectional plan view of a portion of a liquid ejection head according to an eighth embodiment of the present disclosure.
Figure 30:
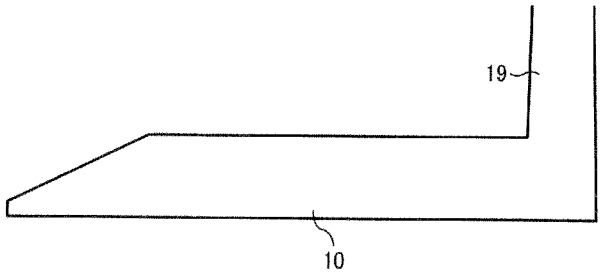
FIG. 30 is a cross-sectional view of a common liquid chamber in a nozzle array direction of the liquid ejection head according to the eighth embodiment.

FIG. 29 is a cross-sectional plan view of a portion of the liquid ejection head according to the eighth embodiment. FIG. 30 is a cross sectional view of a common liquid chamber in a nozzle array direction of the liquid ejection head according to the eighth embodiment.

In the present embodiment, the liquid ejection head has a liquid introduction portion 81 communicating with all individual liquid chambers 6 by causing the liquid introduction portions 8 according to the first embodiment or the like to mutually communicate in the nozzle array direction. In this case, when a common liquid chamber 10 is set to be a first common liquid chamber, the liquid introduction portion 81 has a function as a second common liquid chamber.

Moreover, a liquid supply port 19 is provided in a frame member 20 and communicates with the common liquid chamber 10. The liquid supply port 19 serves as a liquid supply portion to which liquid is supplied from a liquid storage unit, such as an external head tank or main tank, for storing the liquid.

Furthermore, a damper area 21 is divided into two parts that are disposed at two positions in the nozzle array direction.

The liquid introduction portion 81 provided in a channel plate 2 has an area other than a portion in which a passage 82 communicating with the common liquid chamber 10 is formed. The area of the liquid introduction portion 81 is disposed at a position which is not opposed to the common liquid chamber 10. The passage 82 communicating with the common liquid chamber 10 in the liquid introduction portion 81 is disposed at an end of the liquid introduction portion 81 opposite to an end at which the liquid supply port 19 is disposed in the nozzle array direction.

In a region in which the liquid introduction portion 81 disposed at the position not opposed to the common chamber 10 is formed, the channel plate 2 has a cutout portion 122 not opposed to the damper area 21.

As described above, the liquid introduction portion 81 is disposed so as not to oppose the common chamber 10 in the area other than the passage 82. Such a configuration allows the channel plate 2 to have the cutout portion 122 forming a recessed portion in a direction perpendicular to the nozzle array direction. Thus, the damper area 21 can be disposed at a position corresponding to the cutout portion 122, thus allowing an increase in the width of the damper area 21.

In such a configuration, liquid is supplied from the liquid supply port 19 at an end of the common liquid chamber 10 and introduced into the liquid introduction portion 81 from the passage 82 at the other end. Thus, the liquid can be introduced from the common liquid chamber 10 into the liquid introduction portion 81 without reducing the flow speed of the liquid in the common liquid chamber 10. As a result, even if bubbles are accumulated in the common chamber 10, the bubbles can be efficiently discharged.

In such a case, the common liquid chamber 10 has such a sectional shape that an end portion of the common liquid chamber 10 at the passage 82 side is inclined toward the passage 82, thus further enhancing bubble discharge performance.

Next, a liquid ejection head according to a ninth embodiment of the present disclosure is described below with reference to FIGS. 31 and 32.

Figure 31:
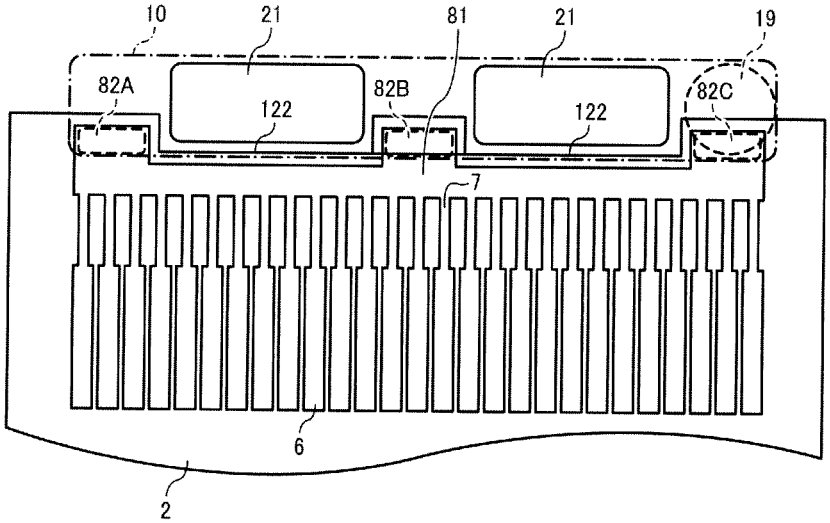
FIG. 31 is a cross-sectional plan view of a portion of a liquid ejection head according to a ninth embodiment of the present disclosure.
Figure 32:
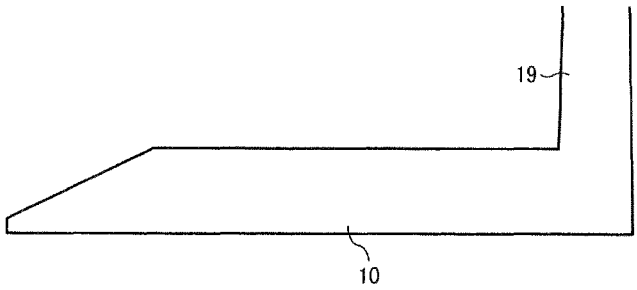
FIG. 32 is a cross-sectional view in a common liquid chamber in a nozzle array direction of the liquid ejection head according to the ninth embodiment.

FIG. 31 is a cross-sectional plan view of a portion of the liquid ejection head according to the ninth embodiment. FIG. 32 is a cross sectional view of a common liquid chamber 10 in a nozzle array direction of the liquid ejection head according to the ninth embodiment.

For the present embodiment, in the configuration of the above-described eighth embodiment, the passage 82 from the common liquid chamber 10 to the liquid introduction portion 81 is provided in three places (or four or more places) including both ends (passages 82A and 82C) and a central part (passage 82B) in the nozzle array direction.

A channel plate 2 has cutout portions 122 and 122 in two places corresponding to two damper areas 21.

As described above, introducing liquid from the common liquid chamber 10 to the liquid introduction portion 8 through the passages 82 can reduce ejection failures that may be caused by the shortage of liquid supplied from the common liquid chamber 10 to the liquid introduction portion 8 (reduction in refill performance).

Next, a liquid ejection head according to a tenth embodiment of the present disclosure is described with reference to FIG. 33.

Figure 33:
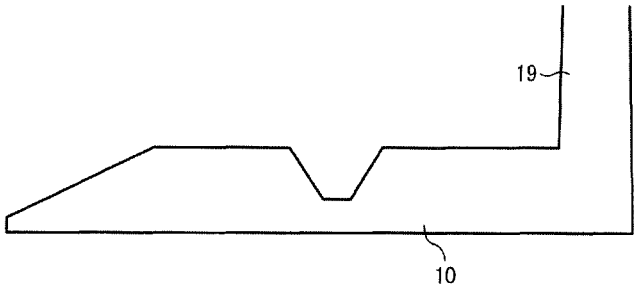
FIG. 33 is a cross-sectional view a common liquid chamber of a liquid ejection head in a nozzle array direction according to a tenth embodiment of the present disclosure.

FIG. 33 is a cross sectional view of a common liquid chamber in a nozzle array direction of the liquid ejection head according to the tenth embodiment.

For the present embodiment, in the above-described configuration of the ninth embodiment, the common chamber 10 has a smaller depth at a position of the central part corresponding to the passage 82B.

Such a configuration facilitates bubbles to be discharged from the passage 82B corresponding to the central part, thus allowing more efficient bubble discharge.

Next, a liquid ejection head according to an eleventh embodiment of the present disclosure is described below with reference to FIGS. 34 and 35.

Figure 34:
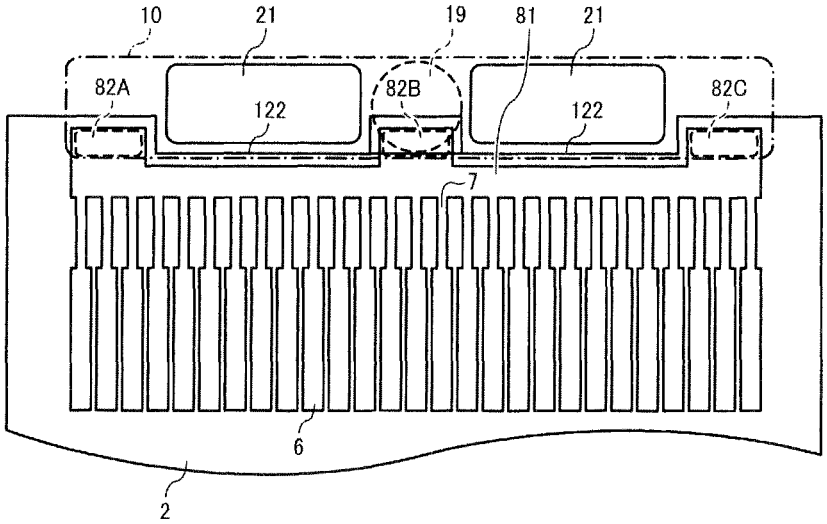
FIG. 34 is a cross-sectional plan view of a portion of a liquid ejection head according to an eleventh embodiment of the present disclosure.
Figure 35:
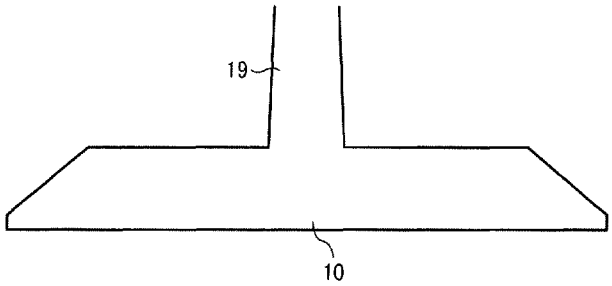
FIG. 35 is a cross-sectional view of a common liquid chamber in a nozzle array direct on of the liquid ejection head according to the eleventh embodiment.

FIG. 34 is a cross-sectional plan view of a portion of the liquid ejection head according to the eleventh embodiment. FIG. 35 is a cross sectional view of a common liquid chamber 10 in a nozzle array direction of the liquid ejection head according to the eleventh embodiment.

For the present embodiment, in the configuration of the ninth embodiment, a liquid supply port 19 communicating with the common liquid chamber 10 is disposed on the central part in the nozzle array direction.

Such a configuration can maintain a flow speed of liquid at both ends of the common liquid chamber 10 and reduce pressure loss due to a fluid resistance of the passage 82 connected to the liquid introduction portion 81 without generating a stagnation part of a liquid flow.

Next, a liquid ejection head according to a twelfth embodiment of the present disclosure is described below with reference to FIGS. 36 and 37.

Figure 36:
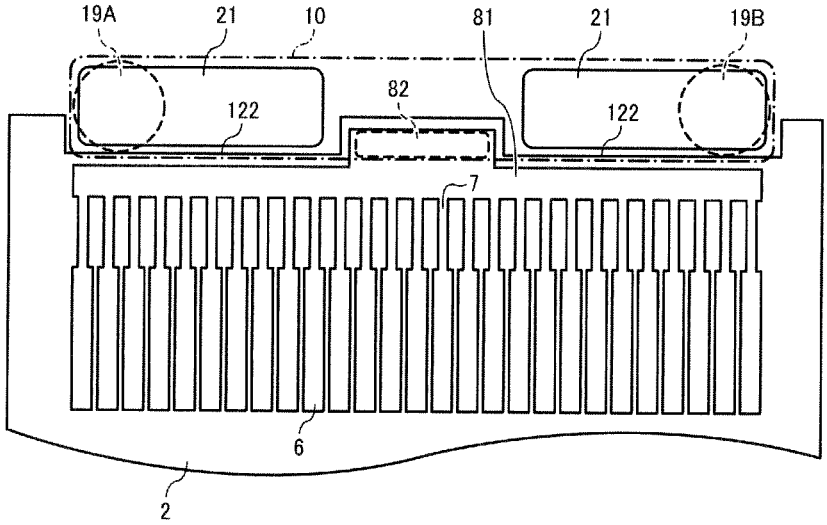
FIG. 36 is a cross-sectional plan view of a portion of a liquid ejection head according to a twelfth embodiment of the present disclosure.
Figure 37:
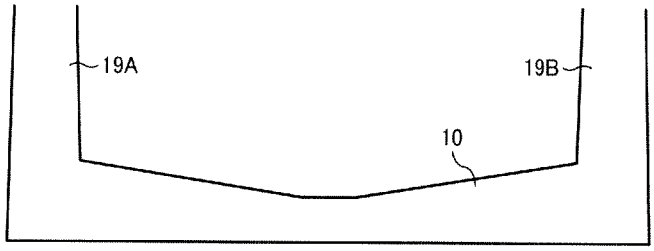
FIG. 37 is a cross-sectional view of a common liquid chamber in a nozzle array direction of the liquid ejection head according to the twelfth embodiment.

FIG. 36 is a cross-sectional plan view of a portion of the liquid ejection head according to the twelfth embodiment. FIG. 37 is a cross sectional view of a common liquid chamber in a nozzle array direction of the liquid ejection head according to the twelfth embodiment.

In the present embodiment, a passage 82 from a common liquid chamber 10 to a liquid introduction portion 81 is disposed on a central part in the nozzle array direction, and liquid supply ports 19A and 19B are disposed on both ends in the nozzle array direction of the common liquid chamber 10. In the present embodiment, the passage 82 has a greater length in the nozzle array direction than that of the eleventh embodiment.

Such a configuration can maintain a flow speed of liquid at both ends of the common liquid chamber 10 and reduce pressure loss due to a fluid resistance of the passage 82 connected to the liquid introduction portion 81 without generating a stagnation part of a liquid flow.

In the above-described eighth to twelfth embodiments, the cutout portion 122 to avoid the damper area 21 is provided in a portion of the channel plate 2 for forming the liquid introduction portion 81 disposed at a position at which the channel plate 2 is not opposed to the common liquid chamber 10. Alternatively, the same structure as that of the above-described first embodiment may be employed.

In other words, the portion of the channel plate 2 for forming the liquid introduction portion 81 disposed at the position not opposed to the common liquid chamber 10 may be opposed to a portion of the damper area 21. The relief 22 for permitting the deformation of the damper area 21 may be provided at the damper area 21 side in the portion of the channel plate 2 which is opposed to the damper area 21.

Next, an image forming apparatus according to at least one embodiment of this disclosure is described with reference to FIGS. 38 and 39.

Figure 38:
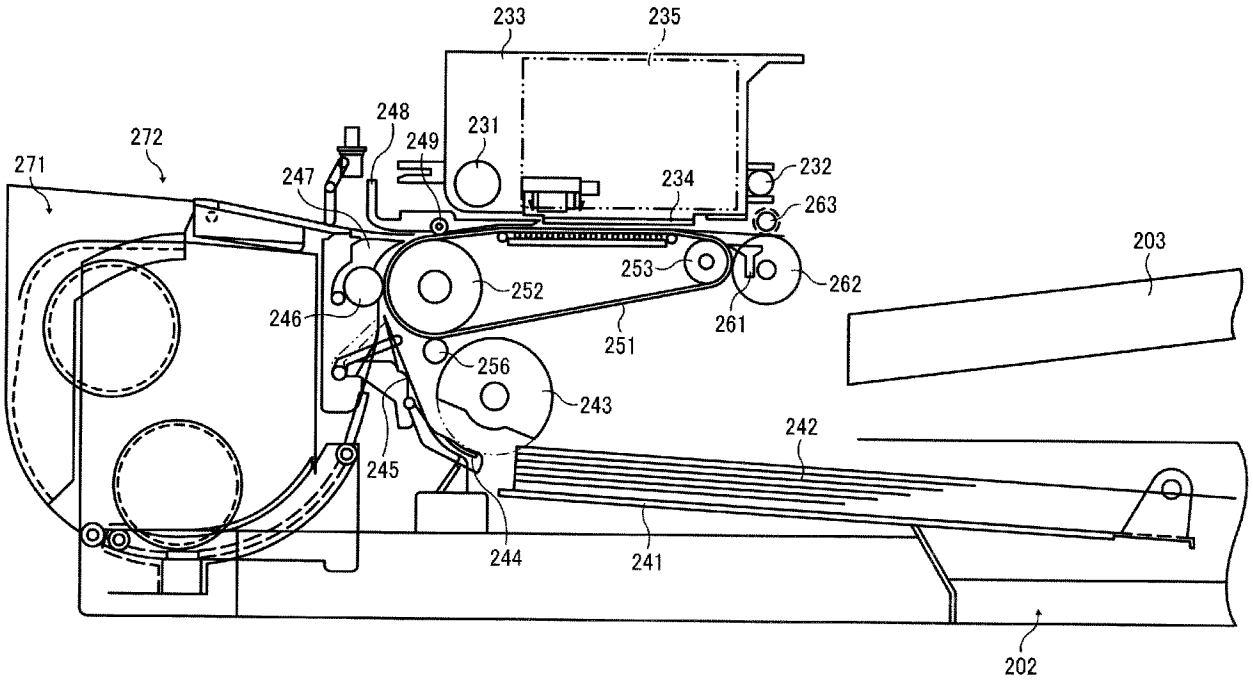
FIG. 38 is a side view of a mechanical section of an image forming apparatus according to an embodiment of the present disclosure.

FIG. 38 is a side view of a mechanical section of an image forming apparatus according to at least one embodiment of this disclosure. FIG. 39 is a partial plan view of the mechanical section of FIG. 11.

Figure 39:
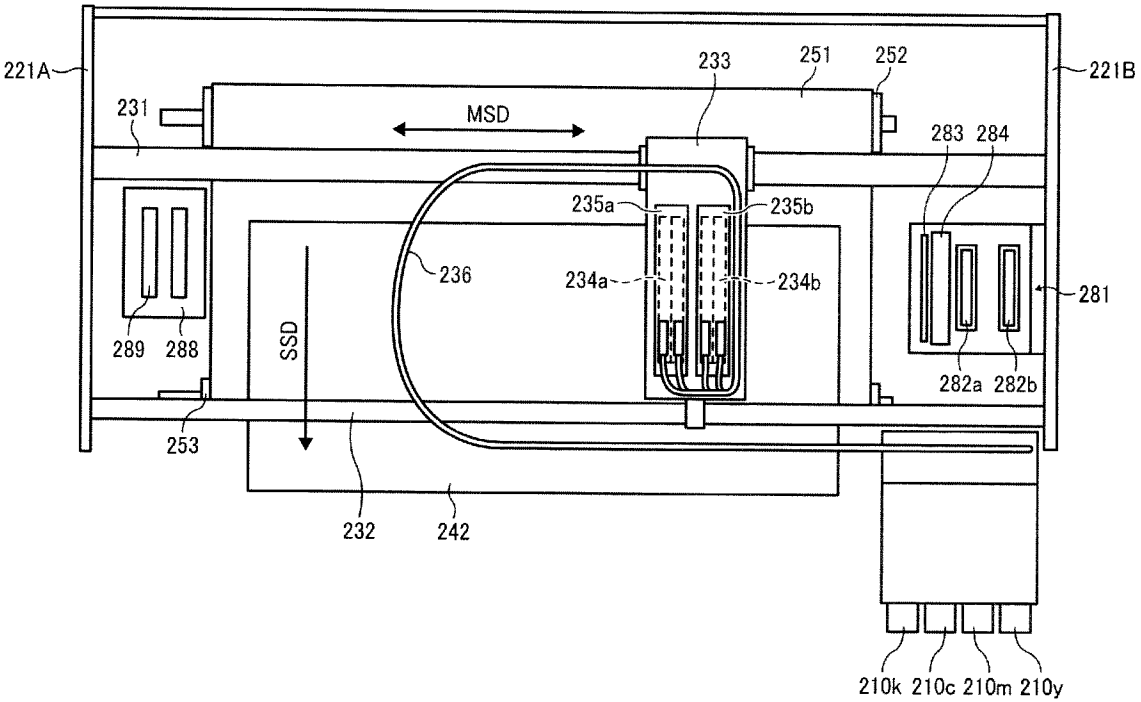
FIG. 39 is a plan view of a portion of the mechanical section illustrated in FIG. 38.

The image forming apparatus illustrated in FIGS. 38 and 39 is a serial-type image forming apparatus. In the image forming apparatus, a carriage 233 is supported by a main guide rod 231 and a sub guide rod 232 so as to be slidable in a direction (main scanning direction) indicated by arrow MSD in FIG. 39. The main guide rod 231 and the sub guide rod 232 serving as guide members extend between a left side plate 221A and a right side plate 221B. The carriage 233 is reciprocally moved for scanning in the main scanning direction MSD by a main scanning motor via a timing belt.

The carriage 233 mounts recording heads 234*a* and 234*b* (collectively referred to as "recording heads 234" unless distinguished) serving as liquid ejection heads for ejecting ink droplets of different colors, e.g., yellow (Y), cyan (C), magenta (M), and black (K). The recording heads 234*a* and 234*b* are mounted on the carriage 233 so that nozzle rows, each of which includes multiple nozzles, are arranged in parallel to a direction (sub scanning direction indicated by arrow SSD in FIG. 39) perpendicular to the main scanning direction MSD and ink droplets are ejected downward from the nozzles.

Each of the recording heads 234*a* and 234*b* serving as the liquid ejection heads has two nozzle rows. In the present embodiment, for example, one of the nozzles rows of the recording head 234*a* ejects liquid droplets of black (K) and the other ejects liquid droplets of cyan (C). In addition, one of the nozzles rows of the recording head 234*b* ejects liquid droplets of magenta (M) and the other ejects liquid droplets of yellow (Y). It is to be noted that the image forming apparatus illustrated in FIGS. 38 and 39 ejects four color liquids in the above-described two-head configuration. Alternatively, in an embodiment, an image forming apparatus may include a single recording head having four nozzle rows to eject liquid droplets of four colors.

A supply unit replenishes and supplies respective color inks from ink cartridges 210 to head tanks 235 of the recording heads 234 via supply tubes 236.

The image forming apparatus further includes a sheet feed section to feed sheets 242 stacked on a sheet stack portion (platen) 241 of a sheet feed tray 202. The sheet feed section further includes a sheet feed roller 243 and a separation pad 244. The sheet feed roller 243 has, e.g., a half moon shape to separate the sheets 242 from the sheet stack portion 241 and feed the sheets 242 sheet by sheet. The separation pad 244 is disposed opposing the sheet feed roller 243 and urged toward the sheet feed roller 243.

To feed the sheet 242 from the sheet feed section to a position below the recording heads 234, the image forming apparatus illustrated in FIGS. 38 and 39 includes a first guide member 245 to guide the sheet 242, a counter roller 246, a conveyance guide member 247, and a pressing member 248 including a leading-end pressing roller 249. The image forming apparatus also includes a conveyance belt 251 to adhere the sheet 242 thereon by static electricity and convey the sheet 242 to a position opposing the recording heads 234.

The conveyance belt 251 is an endless belt that is looped between a conveyance roller 252 and a tension roller 253 so as to circulate in a belt conveyance direction (sub-scanning direction indicated by arrow SSD in FIG. 39). The image forming apparatus also has a charging roller 256 serving as a charging device to charge the surface of the conveyance belt 251. The charging roller 256 is disposed so as to contact an outer surface of the conveyance belt 251 and rotate with the circulation of the conveyance belt 251. The conveyance roller 251 is rotated by a sub scanning motor via a timing belt, so that the conveyance belt 251 circulates in the belt conveyance direction.

The image forming apparatus further includes a sheet output section to output the sheet 242 on which an image has been formed by the recording heads 234. The sheet output section includes a separation pawl 261 to separate the sheet 242 from the conveyance belt 251, a first output roller 262, a spur 263 serving as a second output roller, and a sheet output tray 203 disposed at a position lower than the first output roller 262.

A duplex unit 271 is detachably mounted on a rear face portion of the apparatus body. When the conveyance belt 251 rotates in reverse to return the sheet 242, the duplex unit 271 receives the sheet 242. The duplex unit 271 reverses and feeds the sheet 242 to a nipping portion between the counter roller 246 and the conveyance belt 251. A bypass tray 272 is formed at an upper face of the duplex unit 271.

As illustrated in FIG. 39, a maintenance device (maintenance and recovery device) 281 is disposed in a non-printing area (non-recording area) at one end in the main scanning direction MSD of the carriage 233. The maintenance device 281 maintains and recovers nozzle conditions of the recording heads 234. The maintenance device 281 includes caps 282*a* and 2826, a wiping member 283, and a first dummy-ejection receptacle 284. The caps 282*a* and 282*b*(hereinafter, collectively referred to as "caps 282" unless distinguished) cap nozzle faces of the recording heads 234. The wiping member (wiper blade) 283 serves as a blade member to wipe the nozzle faces of the recording heads 234. The first dummy-ejection receptacle 284 receives liquid droplets ejected by dummy ejection in which liquid droplets not contributing to image recording are ejected to remove viscosity-increased recording liquid.

As illustrated in FIG. 39, a second dummy ejection receptacle 288 is disposed at a non-printing area on the opposite end in the main scanning direction MSD of the carriage 233. The second dummy ejection receptacle 288 receives liquid droplets ejected, e.g., during recording (image forming) operation by dummy ejection in which liquid droplets not contributing to image recording are ejected to remove viscosity-increased recording liquid. The second dummy ejection receptacle 288 has openings 289 arranged in parallel to the nozzle rows of the recording heads 234.

In the image forming apparatus having the above-described configuration, the sheet 242 is separated sheet by sheet from the sheet feed tray 202, fed in a substantially vertically upward direction, guided along the first guide member 245, and conveyed while being sandwiched between the conveyance belt 251 and the counter roller 246. Further, the leading end of the sheet 242 is guided by a conveyance guide member 237 and is pressed against the conveyance belt 251 by the leading-end pressing roller 249 to turn the transport direction of the sheet 242 by approximately 90°.

When the sheet 242 is fed onto the charged conveyance belt 251, the sheet 242 adheres to the conveyance belt 251 and is conveyed in the sub scanning direction by the circulation of the conveyance belt 251.

By driving the recording heads 234 in accordance with image signals while moving the carriage 233, ink droplets are ejected onto the sheet 242, which is stopped below the recording heads 234, to form one line of a desired image. Then, after the sheet 242 is fed by a certain distance, the recording heads 234 record another line of the image. Receiving a recording end signal or a signal indicating that the rear end of the sheet 242 has arrived at the recording area, the recording operation finishes and the sheet 242 is output to the sheet output tray 203.

As described above, the image forming apparatus has, as the recording heads, the liquid ejection heads according to any of the above-described embodiments, thus allowing stable formation of high-quality images.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid ejection head, comprising:

a nozzle plate including plural nozzles to eject droplets of liquid;

a channel plate including individual liquid chambers communicated with the nozzles;

a common-liquid-chamber member including a common liquid chamber to supply the liquid to the individual liquid chambers; and a deformable damper area forming a wall face of the common liquid chamber, wherein the channel plate has an end portion disposed at an end of the channel plate, in a direction perpendicular to a nozzle array direction in which the nozzles are arrayed, and an outer surface of the end portion of the channel plate is opposed to a portion of the damper area, and said end portion of the channel plate has a relief at a side facing said portion of the damper area to permit deformation of the damper area.

2. The liquid ejection head of claim 1, wherein the relief has at least one of a stepwise shape, a tapered shape, a round shape, and a sawtooth shape in a cross section along a liquid supply direction in which the liquid is supplied from the common liquid chamber.

3. The liquid ejection head of claim 1, further comprising a diaphragm member forming a wall face of each of the individual liquid chambers, wherein the damper area is formed of a portion of the diaphragm member.

4. An image forming apparatus, comprising the liquid ejection head of claim 1.

5. The liquid ejection head of claim 1, wherein the damper area is a section of a wall surface member forming the wall face of the common liquid chamber.

6. The liquid ejection head of claim 5, wherein the wall surface member includes plural damper areas along the nozzle array direction.

7. The liquid ejection head of claim 6, wherein a section of the channel plate opposes the wall surface member between adjacent damper areas, and said section of the channel plate does not have a relief and is bonded with adhesive to the wall surface member.

* * * * *